United States Patent [19]

Brown

[11] 4,051,938

[45] Oct. 4, 1977

[54] MEANS FOR OUTSIDE VENDING

[76] Inventor: Kenneth G. Brown, Wickham Ave., Mattituck, N.Y. 11952

[21] Appl. No.: 691,229

[22] Filed: June 1, 1976

[51] Int. Cl.[2] ..... G07F 9/06

[52] U.S. Cl. ..... 194/1 K

[58] Field of Search ..... 194/1 A, 1 B, 1 K, DIG. 9, 194/4 R, 10, 13, 2; 232/43.1; 179/179, 6.3 R

[56] References Cited

U.S. PATENT DOCUMENTS

| | | | |
|---|---|---|---|
| 1,949,283 | 2/1934 | Murtaugh, Jr. | 194/DIG. 26 |
| 2,002,753 | 5/1935 | Parks et al. | 194/4 R |
| 3,148,246 | 9/1964 | Hannula | 179/6.3 R |
| 3,325,090 | 6/1967 | O'Brien | 232/15 X |
| 3,386,550 | 6/1968 | Murray et al. | 194/10 |

*Primary Examiner*—Stanley H. Tollberg

*Attorney, Agent, or Firm*—James P. Malone

[57] ABSTRACT

Adapter for installing, inside a building wall, a vending machine coin box of the type normally mounted outdoors. The coin box is mounted on the inside of the wall, the coin box having a coin receiving aperture, a coin return slot and a coin return lever. A first chute is mounted in the wall and connected to the coin receiving aperture, the first chute extending downwardly from the outside of the wall. A second chute is mounted in the wall connected to the coin return slot, the second chute extending downwardly from the inside to the outside of the wall. A coin return bar extends through the wall and connected to operate the coin return lever, whereby the coin box is protected from vandalism and burglary.

7 Claims, 7 Drawing Figures

MEANS FOR OUTSIDE VENDING

This invention relates to outside vending apparatus and more particularly to protecting the coin box when vending merchandise outdoors.

Outdoor vending machines for dispensing milk, ice and grocery items are very popular and efficient as they can be operated 24 hours a day, 7 days a week. A major problem with outdoor vending apparatus is that it is difficult or impossible to protect the coin box from vandalism and burglary. The present invention solves this problem by mounting the coin box inside a structural wall of a building but permits operation from outside the building.

More particularly, the present invention provides means to adapt the conventional coin box vending machine for inside mounting said outside operation. In the present invention, the coin box is mounted on the inside of the building wall and chutes are provided to receive the coins and for coin return. A coin return bar extends through the wall and is connected to operate the coin return lever of the conventional coin box. The articles are delivered through an aperture cut in the wall. Therefore, the coin box is fully protected from vandalism and burglary unless the building is actually broken into.

With the present invention, the coin box does not have to be protected by a heavy steel casing as in the case of outside installation, which is ineffective in any event.

Accordingly, a principal object of the invention is to provide new and improved outside vending means.

Another object of the invention is to provide new and improved means for adapting conventional vending apparatus for outside operation, with the vending machine mounted inside.

Another object of the invention is to provide new and improved means for adapting conventional vending apparatus for outside operation wherein the vending machine is also adapted for inside merchandising.

Another object of the invention is to provide new and improved means for installing, inside a building wall, a vending machine coin box of the type normally mounted outdoors comprising, a coin box mounted on the inside of the wall, the coin box having a coin receiving aperture, a coin return slot and a coin return lever, a first chute mounted in the wall and connected to the coin receiving aperture, said first chute extending downwardly from the outside of the wall, a second chute mounted in the wall connected to the coin return slot, said second chute extending downwardly from the inside to the outside of the wall, a coin return bar extending through the wall and connected to operate the coin return lever, whereby the coin box is protected from vandalism and burglary.

These and other objects of the invention will be apparent from the following specification and drawings, of which:

Figure 1:
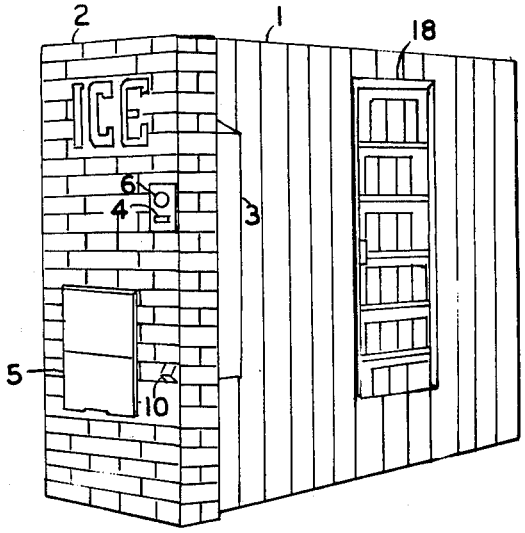
FIG. 1 is a perspective view of an embodiment of the invention mounted behind a brick wall.

Referring to the drawings, FIG. 1 comprises a conventional vending machine 15 which is mounted behind the exterior brick wall 2, of the building. The coin box 3, is mounted inside the wall. The coin box may be conventional. Coins are inserted through the slot 4, and the merchandise is delivered through the delivery gate 5. A conventional "empty" light 6, is also provided.

Figure 2:
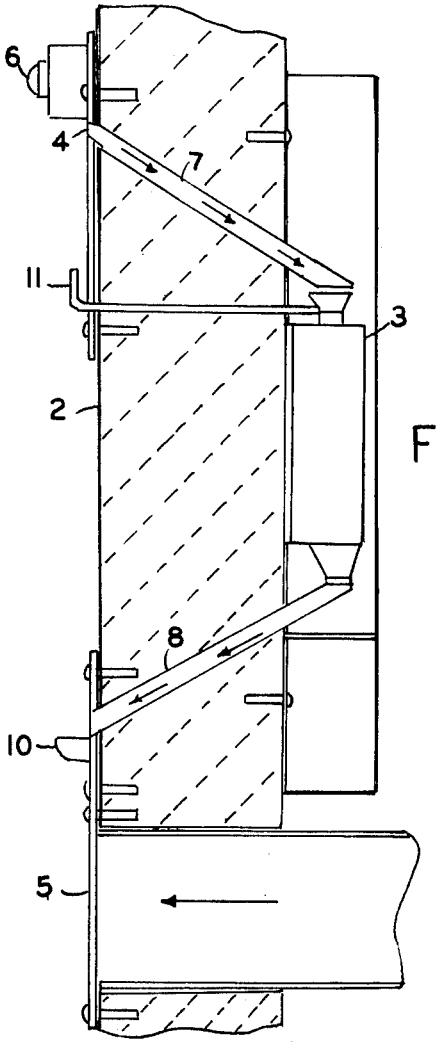
FIG. 2 is a sectional view illustrating the connections from the outside wall to the interior mounted coin box.

Referring to FIG. 2, there is shown a detail sectional view illustrating how the conventional coin box 3, is connected for outside operation. The coin slot 4, is connected to the coin slot of the coin box by means of the chute 7, which extends downwardly so that the coins will be delivered by gravity to the coin-box 3. A second chute 8, is connected to the coin return mechanism of the coin box and the chute 8 extends downwardly to a coin return cup 10, mounted on the outside of the wall. A coin return lever 11, extends through the wall and is adapted to operate the coin return lever 12, of the conventional coin box as shown in FIG. 5.

Figure 5:
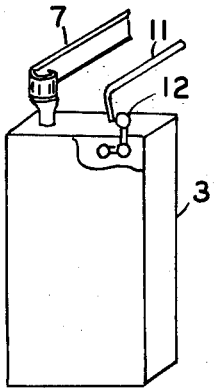
FIG. 5 is a detail view of the coin box control means.

FIG. 5 also illustrates how the coin inserting chute 7, is connected to the input coin cup 13, of the conventional coin box 3.

Figure 3:
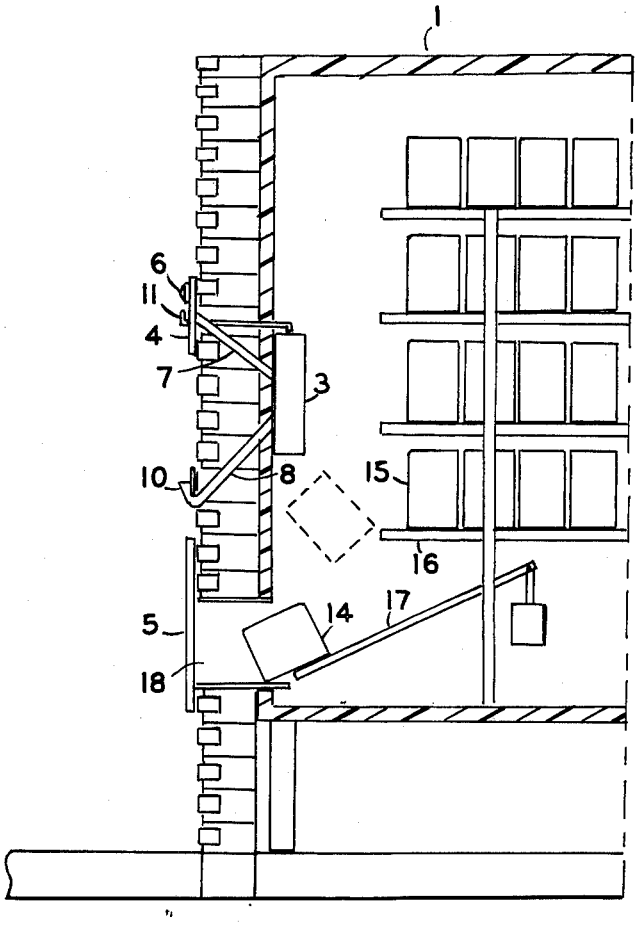
FIG. 3 is a side sectional view illustrating the operation of the embodiment of FIG. 1.

FIG. 3, illustrates how packages of ice cubes 14, 15, etc., may be delivered through the delivery gate 5, through an aperture cut in the wall. The merchandise is preferably delivered by gravity so that it will slide through the aperture 18, and be delivered to the customer.

In operation, the desired number of coins are inserted through the chute 7, to the coin box 3, which is electrically connected in conventional manner to operate the conventional vending machine 1.

In the conventional vending machine, the lower row of bags of ice or other merchansie is pushed to the end of the shelf 16, where one package 14, drops off on to the counter-weighted shock plate 17, where it is delivered to the delivery chute. The vending machine may be manufactured by K. G. BROWN MFG. CO., INC., MATTITUCK, NY, and the coin box may be manufactured by NATIONAL REJECTORS INC., ST. LOUIS, MI.

Other conventional vending machines and coin boxes may be adapted for outside delivery by means of the present invention.

Another advantage of the present invention is that the interior mounted vending machine 1, has a manually operated delivery door 18, for inside merchandising of the products. When the store is open for business, the customers may purchase by opening the door 18, and removing articles to be purchased. When the store is closed for the night, then the automatic operation is activated by flipping the power switch, and the merchandise can be automatically vended from the exterior of the store through the delivery gate 5.

Figure 4:
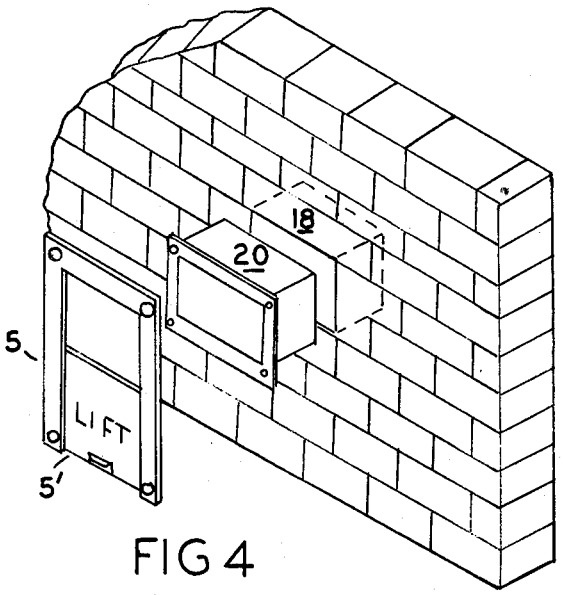
FIG. 4 is a detail view of the delivery chute.

FIG. 4, shows a detail view of a typical installation of the delivery chute, the aperture 18, is cut through the wall 2, and a plastic liner 20, is inserted therein. A metal gate 5, is then bolted to the wall with lag bolts. The delivery gate 5, preferably has a cover 5', which is lifted up to receive the merchandise.

The installation is completed by drilling holes through the wall and inserting the chutes 7 and 8, and affixing the coin slot panel 4, to the wall with lag bolts. A coin delivery cup 10, is also bolted to the wall at the end of the chute 8. The coin return lever 11, is inserted through another hole drilled in the wall to operate the conventional coin return lever 12, of the conventional coin box 3, as shown in FIG. 5.

This coin box installation is done indoors for two reasons, and the most important, is that vandalism is eliminated. The other, is that the coin mechanism operates more efficiently indoors, out of the weather. Another difference about this operation is that this vending cabinet also serves as a merchandiser for indoor shoppers through its large glass door 18, during business hours and at the same time it serves as a vendor for outdoor sales, 24 hours per day.

Figure 6:
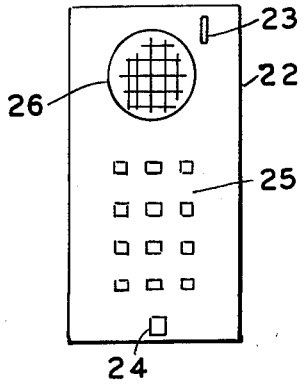
FIG. 6 is a front view of an embodiment of the invention applied to a pay telephone.
Figure 6A:
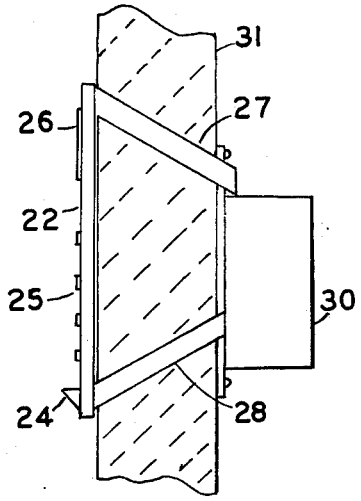
FIG. 6A is a side view of FIG. 6, partly in section.

Referring to FIGS. 6 and 6A, the invention can also be used for a pay telephone installation. Outside mounted pay telephones are subject to burglary and vandalism. Utilizing the present invention, a control panel 22, is mounted on the outside building wall. The control panel has a coin slot 23, conventional push button controls 25, a coin return cup 24, and a receiver-microphone 26. The coin receiving slot 23, is connected by means of a first chute 27, to the coin receiving slot on the inside wall 31, mounted pay telephone. A second chute 28, is connected from the coin return means of the pay telephone 30, to the coin return cup 24, on the outside mounted panel 22. The pay telephone 30, may be conventional, except, the push buttons 25, are relocated to the panel 22, and the receiver-microphone 26, is also relocated to the panel 22. The use of the receiver-microphone will eliminate the vandalism, such as, the cutting of the cable connected to the conventional hand held receiver transmitter.

This arrangement will effectively protect from burglary and vandalism to the inside mounted apparatus.

Therefore, the present invention provides inexpensive means for adapting conventional vending apparatus for outside vending while at the same time protecting the coin box and vending machines from vandalism and burglary.

I claim:

1. Means for installing, inside an exterior building wall, a vending machine coin box comprising, a coin box mounted on the inside of the exterior building wall, the coin box having a coin receiving aperture, a coin return slot and a coin return lever, a first chute mounted in the exterior building wall and connected to the coin receiving aperture, said first chute extending downwardly from the outside of the wall, a second chute mounted in the exterior building wall connected to the coin return slot, said second chute extending downwardly from the inside to the outside of the wall, whereby the coin box is protected from vandalism and burglary by the exterior building wall.

2. Means for installing, inside an exterior building wall, a vending machine coin box comprising, a coin box mounted on the inside of the exterior building wall, the coin box having a coin receiving aperture, a coin return slot and a coin return lever.

a first chute mounted in the exterior building wall and connected to the coin receiving aperture, said first chute extending downwardly from the outside of the wall, a second chute mounted in the exterior building wall connected to the coin return slot, said second chute extending downwardly from the inside to outside of the wall, whereby the coin box is protected from vandalsim and burglary by the exterior building wall, the vending machine being mounted inside and a delivery chute connected through the wall for outside delivery of merchandise.

3. Apparatus as in claim 2, wherein the interior mounted vending machine has a transparent door for interior delivery of merchandise.

4. Apparatus as in claim 1, having an "empty" indicating light mounted outside the wall, the light being connected to the vending machine to indicate when the vending machine is empty.

5. Apparatus as in claim 1, having a coin return bar extending through the wall and connected to operate the coin return lever.

6. Pay telephone means comprising, a control panel mounted on the outside of a building wall, a pay telephone mounted on the inside of the building wall, said pay telephone having a coin receiving slot and a coin return mechanism, push button control means mounted on the panel and connected to the inside mounted pay telephone, a receiver microphone mounted on the panel and connected to the inside mounted pay telephone, a coin receiving slot mounted in the panel and connected to the coin receiving slot in the pay telephone, a coin return cup mounted on the panel a first chute connecting the panel coin slot to the coin receiving slot in the pay telephone, a second chute connecting the coin return cup on the panel to the coin return means of the inside mounted pay telephone, whereby the coins received are protected from burglary and the inside mounted apparatus is protected from vandalism.

7. Outside mounted control means for a pay telephone mounted inside an external building wall comprising, a control panel mounted on the outside of the wall, push button control means mounted on the panel and connected to the inside mounted pay telephone, a coin slot mounted in the panel is connected to the inside mounted pay telephone and a receiver microphone mounted on the panel and connected to the inside mounted pay telephone, whereby the coins received are protected from burglary and the inside mounted telephone apparatus is substantially protected from vandalism.

* * * * *